US011525573B2

(12) United States Patent
Lee

(10) Patent No.: US 11,525,573 B2
(45) Date of Patent: Dec. 13, 2022

(54) HEAT SHRINK GAS GUN

(71) Applicant: Pro-Iroda Industries, Inc., Taichung (TW)

(72) Inventor: Yung Chieh Lee, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 148 days.

(21) Appl. No.: 17/155,584

(22) Filed: Jan. 22, 2021

(65) Prior Publication Data

US 2021/0247066 A1 Aug. 12, 2021

(30) Foreign Application Priority Data

Feb. 10, 2020 (TW) ..... 109104065

(51) Int. Cl.

| | |
|---|---|
| ***F23D 14/38*** | (2006.01) |
| ***F24H 9/06*** | (2006.01) |
| ***F23D 99/00*** | (2010.01) |
| ***F23D 14/46*** | (2006.01) |

(52) U.S. Cl.

CPC ..... *F23D 14/38* (2013.01); *F23D 14/465* (2013.01); *F23D 91/02* (2015.07); *F24H 9/06* (2013.01); *F23D 2207/00* (2013.01)

(58) Field of Classification Search

CPC ..... F23D 14/38; F23D 14/465; F23D 91/02
See application file for complete search history.

(56) References Cited

U.S. PATENT DOCUMENTS

| | | | | |
|---|---|---|---|---|
| 3,936,678 | A * | 2/1976 | Mohr | F23Q 3/002 361/260 |
| 4,683,370 | A * | 7/1987 | Petersen | B44D 3/168 34/667 |
| 5,798,601 | A * | 8/1998 | Hansen | F23Q 3/002 310/339 |
| 6,059,479 | A * | 5/2000 | Clune | F23Q 3/006 431/258 |
| 8,585,397 | B2 | 11/2013 | Guillou et al. | |
| 10,094,590 | B2 | 10/2018 | Chen | |
| D856,769 | S * | 8/2019 | Boivin | D8/29.1 |

FOREIGN PATENT DOCUMENTS

| | | |
|---|---|---|
| CN | 207762892 U | 8/2018 |
| EP | 1795803 B1 | 8/2017 |

* cited by examiner

*Primary Examiner* — Nathaniel Herzfeld
(74) *Attorney, Agent, or Firm* — Karin L. Williams; Alan D. Kamrath; Mayer & Williams PC

(57) ABSTRACT

A heat shrink gas gun has a handle which has a back side and a front side. The front side of the handle includes a cavity extending along an axis. An igniter is configured for ignition of the heat shrink gas gun and is actuated by a trigger. The igniter is insertably disposed in the cavity. The igniter is releasably received in the cavity. A trigger guard is positioned in front of the trigger and the front side in a spaced relationship. The trigger guard includes a through hole corresponding to the cavity so as to facilitate installation and replacement of the igniter.

21 Claims, 7 Drawing Sheets

HEAT SHRINK GAS GUN

BACKGROUND OF THE INVENTION

1. Field of the Invention

The present invention relates to a heating apparatus and, particularly, to a heat shrink gas gun.

2. Description of the Related Art

Taiwan Pat. No. 1614455 discloses a hot air gun which includes a head defining a channel extending along an axial direction. The channel has an inlet end and an outlet end at different ends. The channel includes an input end, an output end, and a guiding part between the inlet end and the outlet end. The output end forms an opening, which includes two long sides and two short sides. The two long sides are opposite to each other. The short sides are opposite to each other. Moreover, the channel is provided with two guide flanges at the guiding part. The two guide flanges are adjacent to the two long sides, respectively. The two guide flanges are opposite to each other. Further, the hot air gun includes a grip which is conveniently situated and a trigger mounted thereon. The grip is at a lower end of the hot air gun.

The user often encounters a difficulty of holding such hot air gun stably during the operation because it is large in size and produces strong hot air stream.

The present invention is, therefore, intended to obviate or at least alleviate the problems encountered in the prior art.

SUMMARY OF THE INVENTION

According to the present invention, a heat shrink gas gun has a handle which has a back side and a front side. The front side of the handle includes a cavity extending along an axis. An igniter, which is configured for ignition of the heat shrink gas gun and is actuated by a trigger, is insertably disposed in the cavity. The igniter is releasably received in the cavity. A trigger guard is positioned in front of the trigger and the front side in a spaced relationship. The trigger guard includes a through hole corresponding to the cavity so as to facilitate installation and replacement of the igniter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
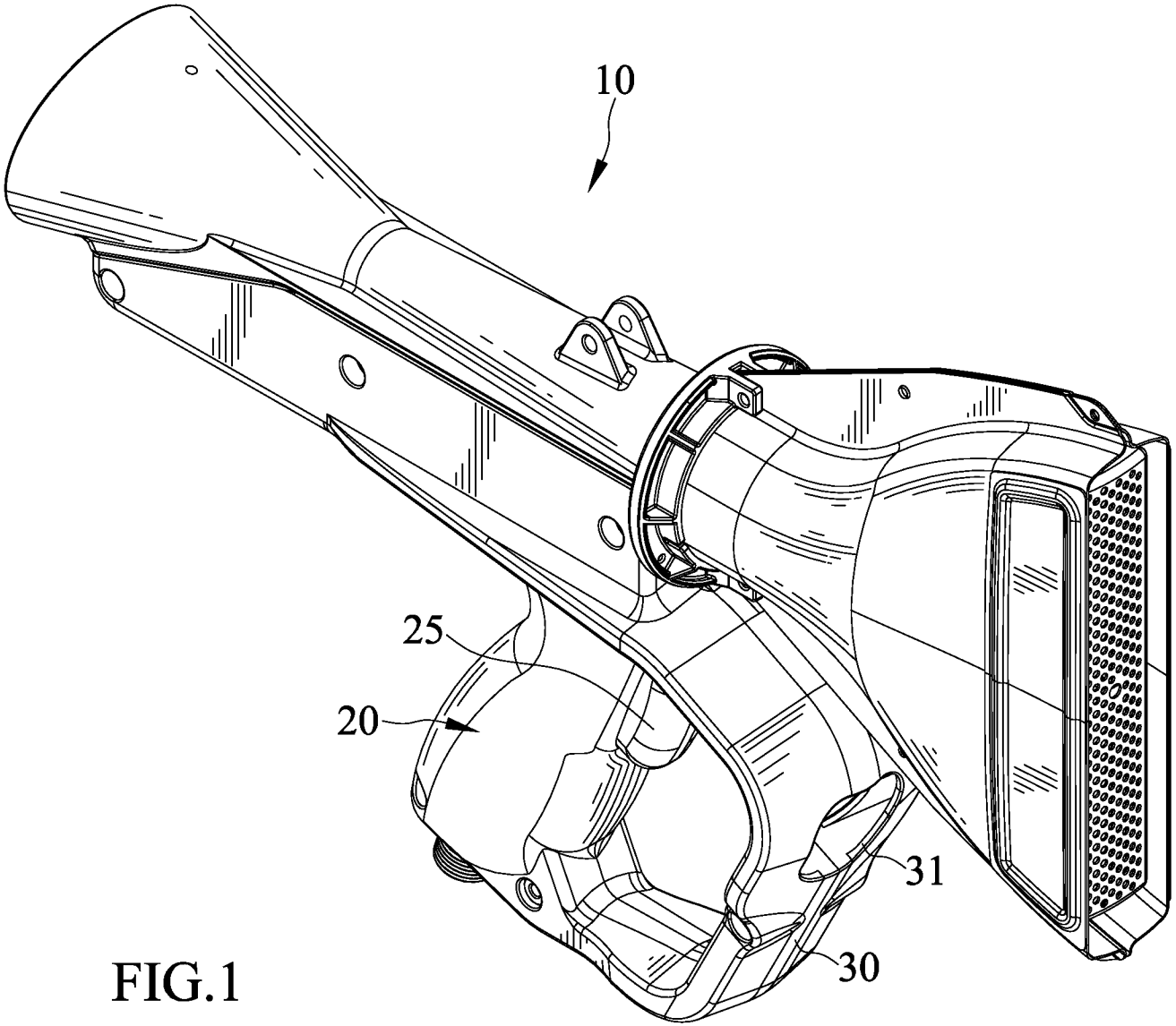
FIG. 1 is a perspective view of a heat shrink gas gun in accordance with the present invention.
Figure 2:
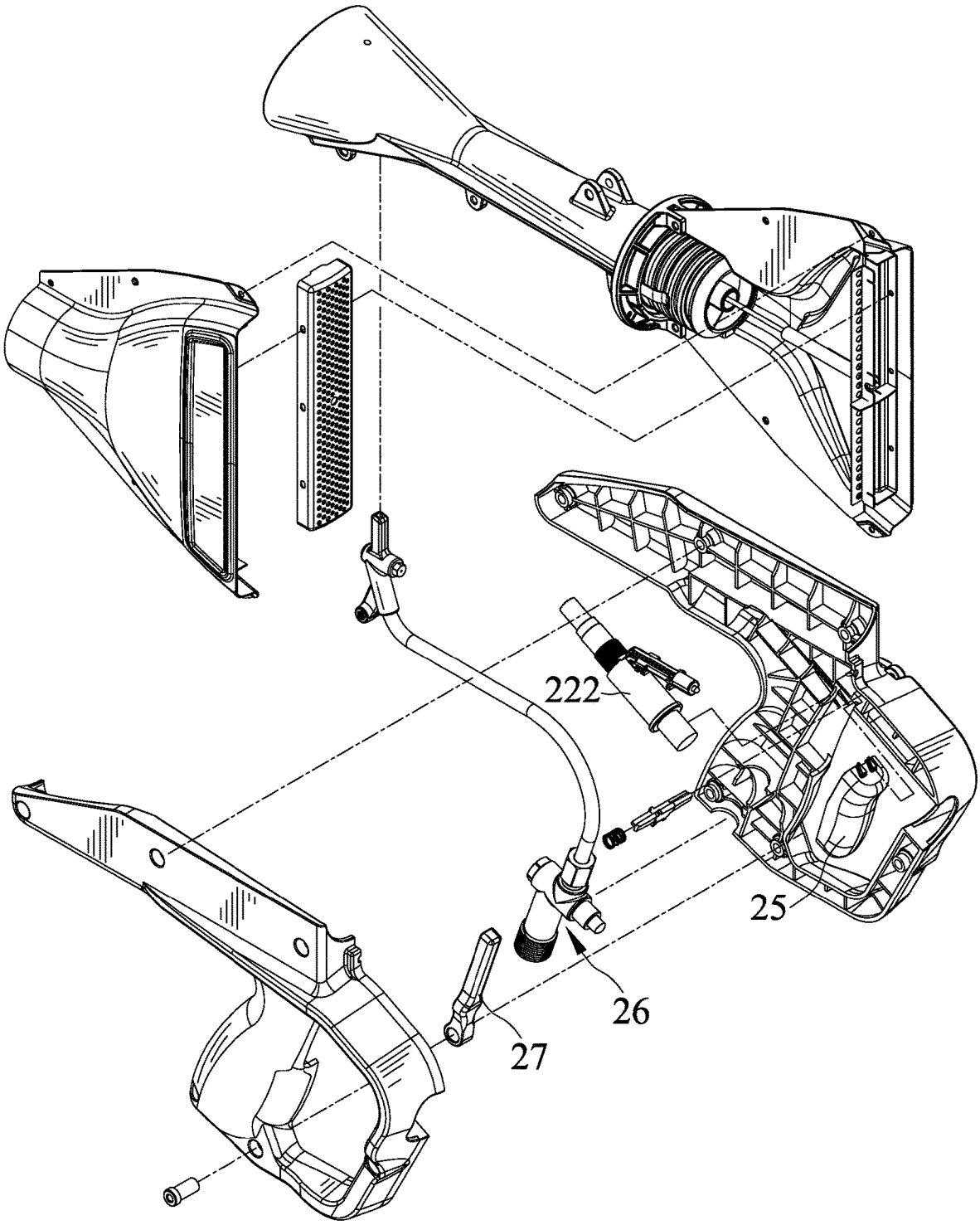
FIG. 2 is an exploded perspective view of FIG. 1.
Figure 3:
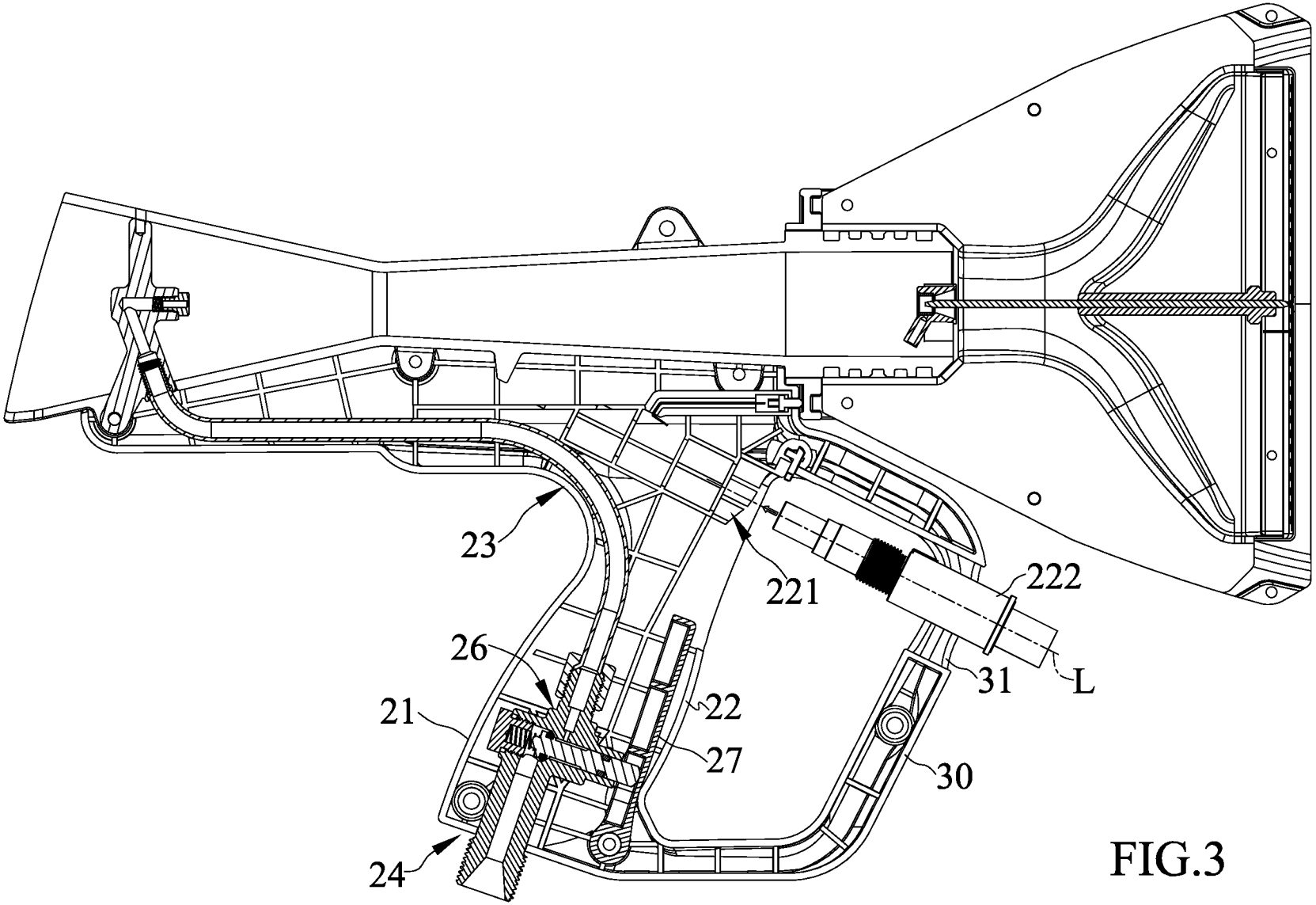
FIG. 3 is a cross-sectional view illustrating the heat shrink gas gun includes an igniter mounted thereon.
Figure 4:
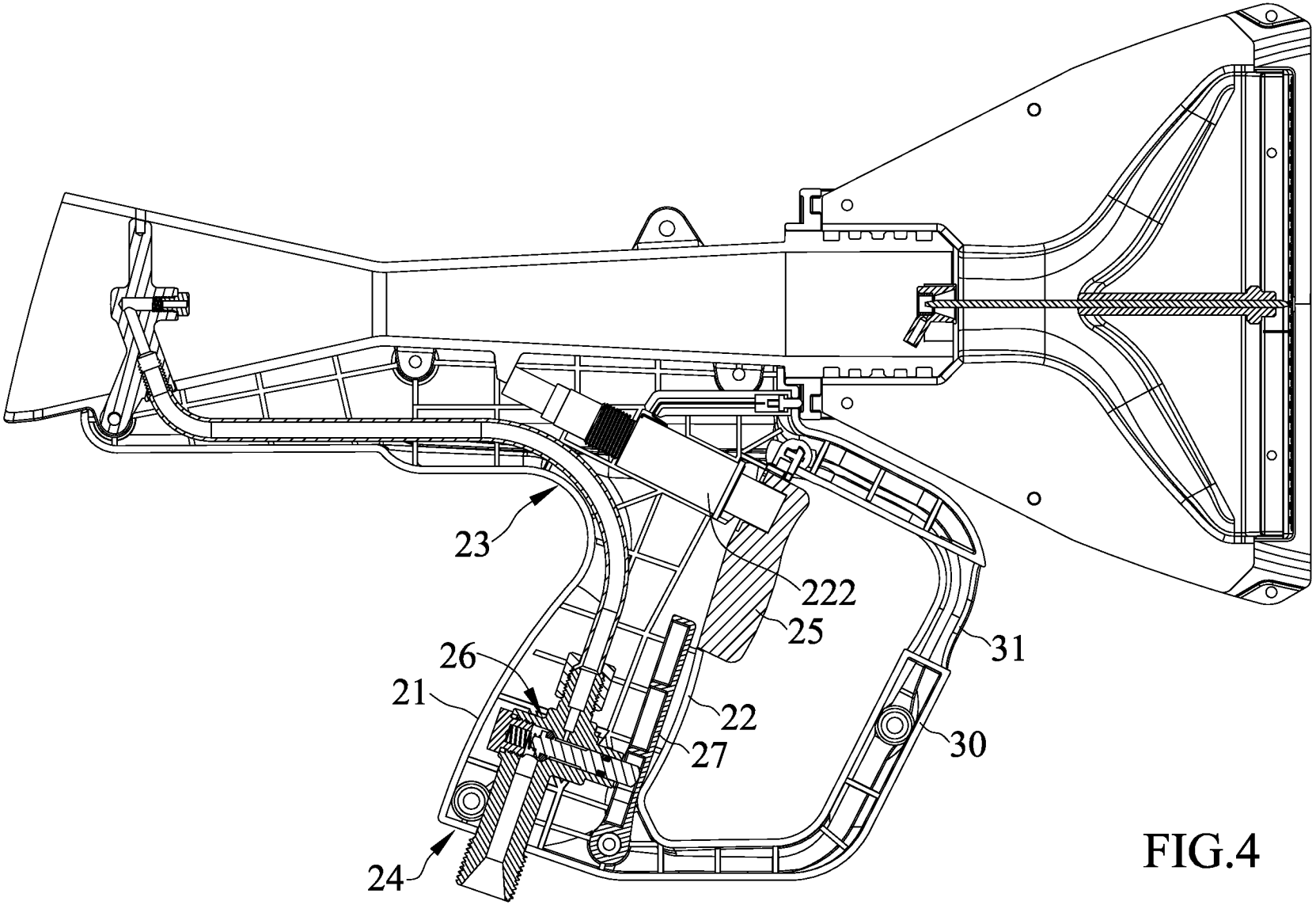
FIG. 4 is a cross-sectional view illustrating the igniter mounted on the heat shrink gas gun.
Figure 5:
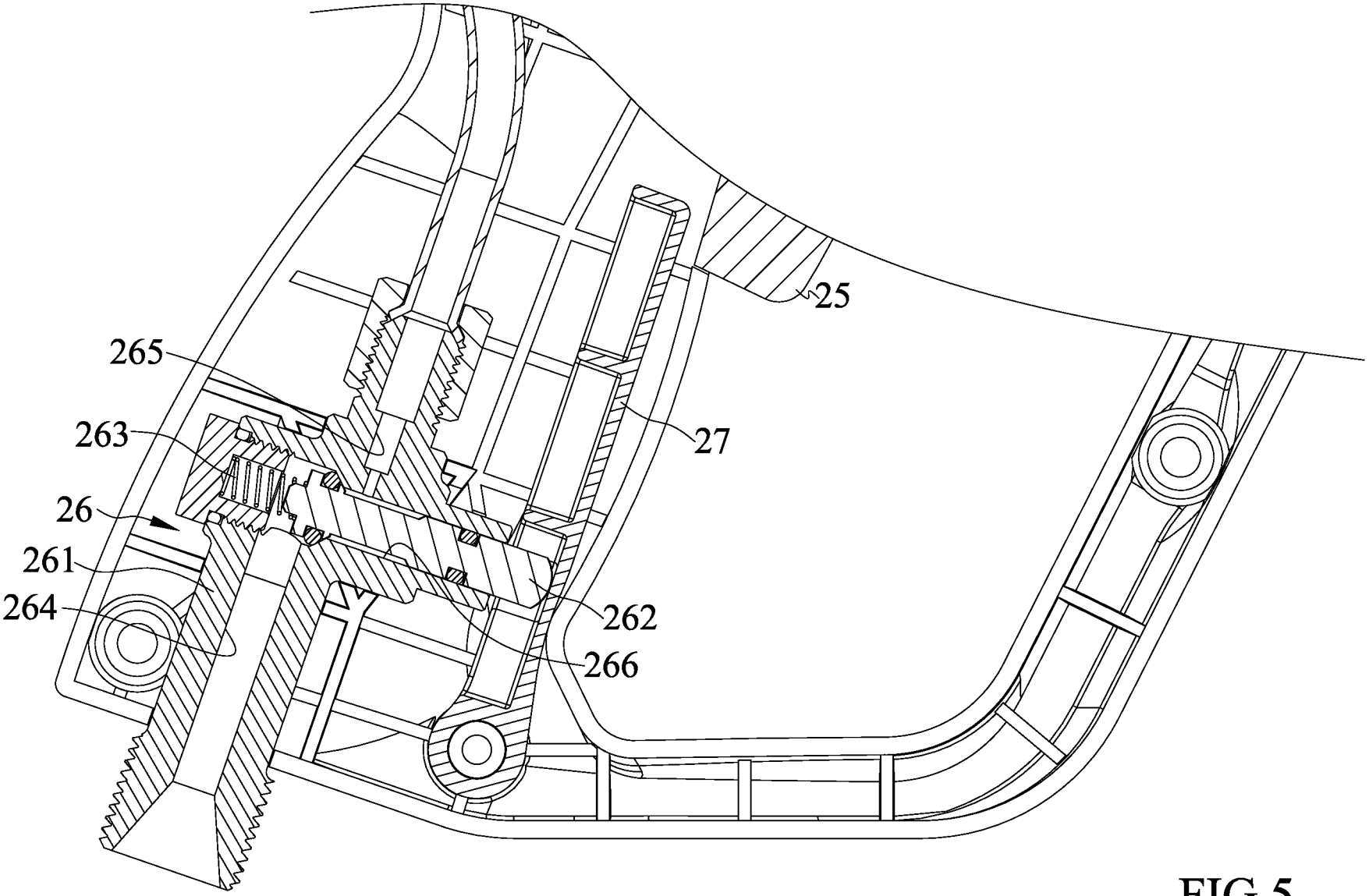
FIG. 5 is a partial, enlarged view of FIG. 4.
Figure 6:
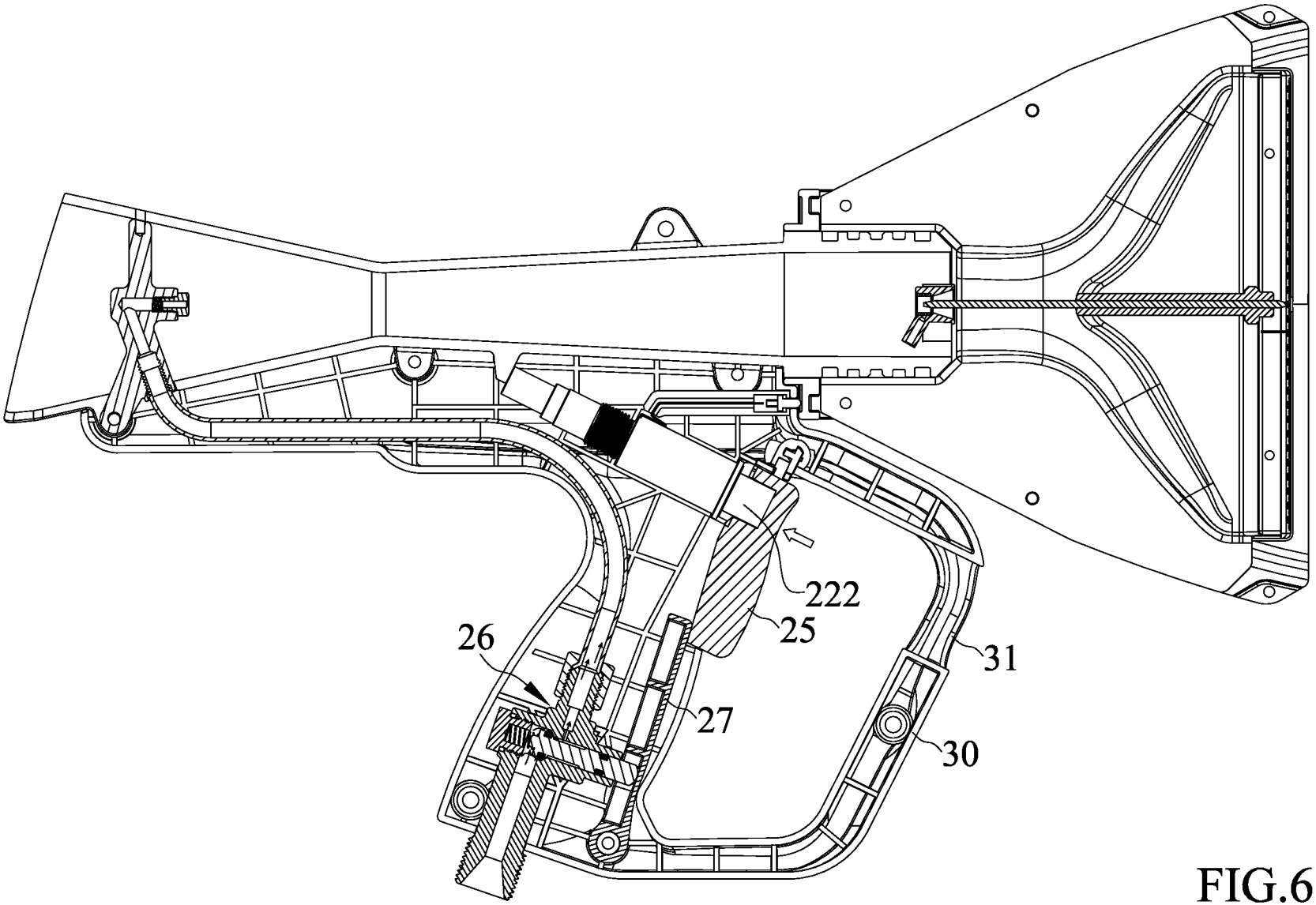
FIG. 6 is a cross-sectional view illustrating the operation of the heat shrink gas gun, with the igniter being actuated by a trigger, and with gas, represented by arrows, flowing in the heat shrink gas gun.
Figure 7:
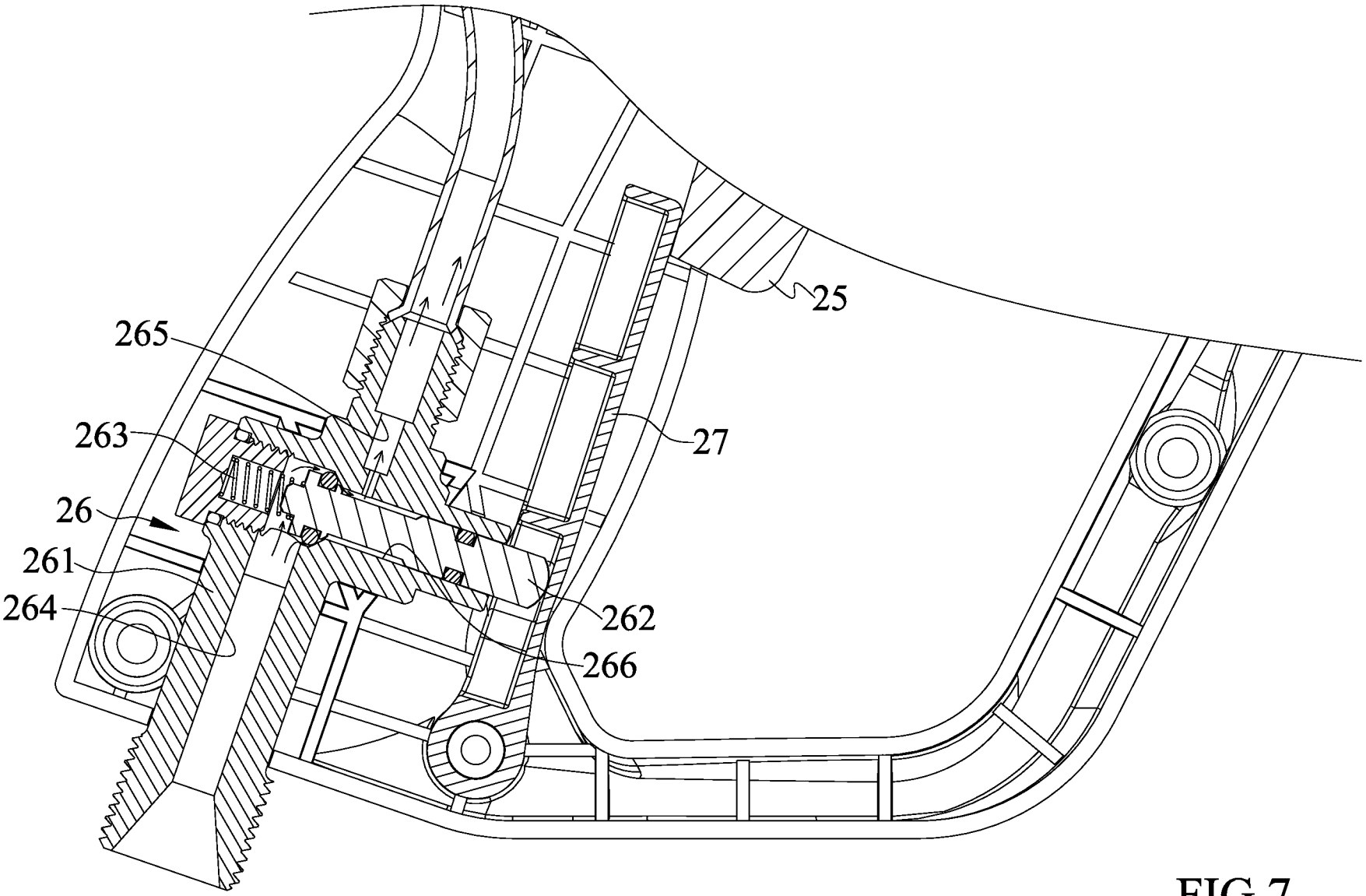
FIG. 7 is a partial, enlarged view of FIG. 6.

FIGS. 1 through 7 show a heat shrink gas gun 10 in accordance with the present invention. The heat shrink gas gun 10 is held via a handle 20. The handle 20 has a back side 21 and a front side 22. The front side 22 includes a cavity 221 extending along an axis L.

An igniter 222, which is configured for ignition of the heat shrink gas gun 10 and is actuated by a trigger 25, is insertably disposed in the cavity 221. The igniter 222 is releasably received in the cavity 221.

A trigger guard 30 is positioned in front of the trigger 25 and the front side 22 in a spaced relationship. The trigger guard 30 includes a through hole 31 corresponding to the cavity 221 so as to facilitate installation and replacement of the igniter 222. The trigger guard 30 is U shaped and includes one end disposed at an upper end 23 of the handle 20 and another end disposed at a lower end 24 of the handle 20 respectively. The handle 20 and the trigger guard 30 cooperatively define a space.

The trigger 25 is movably connected to the handle 20 and selectively closes the cavity 221. The trigger 25 is pivotally connected to the handle 20. The trigger 25 is movable to a disengaging position, a first engaging position, and a second engaging position. The cavity 221 is open for insertion of the igniter 222 when the trigger 25 is at the disengaging position. The cavity 221 is closed by the trigger 25 when the trigger 25 is at either the first or the second engaging positions. The igniter 222 is in an idle position when the trigger 25 is at the first engaging position and is in an employed position when the trigger 25 is at the second engaging position. The trigger 25 actuating the igniter 222 is in connected with the igniter 222.

A valve device 26 is disposed in the handle 20. The valve device 26, which has an inlet end 261 connectible to a fuel supply (not shown) and selectively allows fuel to feed the heat shrink gas gun 10, actuated by the trigger 25. The valve device 26 defines an inlet passage 264 and an outlet passage 265, which cooperatively allow fuel to flow from the inlet end 261 to feed the heat shrink gas gun 10, interconnected by a passage 266. The passage 266 extends transversely to the inlet and the outlet passages 264 and 265. The passage 266 is stepped.

The valve device 26 includes a valve shaft 262, which is configured to selectively permitting and preventing communication of the inlet and the outlet passages 264 and 265, movably disposed in the passage 266 and actuated by the trigger 25. The valve shaft 262 moves axially between a first position in which the inlet and the outlet passages 264 and 265 are communicated and a second position in which the inlet and the outlet passages 264 and 265 are not communicated.

The valve device 26 is actuated by the trigger 25 via a linkage 27. The valve shaft 262 is connected with the linkage 27. The linkage 27 is pivotally mounted in the handle 20. The linkage 27 pivots to move the valve shaft 262 to a position in which the inlet and the outlet passages 264 and 265 are communicated in response to moving the trigger 25 from the first engaging position to the second engaging position.

The valve shaft 262 is urged by a resilient member 263 which recovers to its original shape after the trigger 25 moves from the second engaging position to the first engaging position.

In view of the foregoing, the heat shrink gas gun 10 includes the through hole 31 that facilitates installation and replacement of the igniter 222.

The foregoing is merely illustrative of the principles of this invention and various modifications can be made by those skilled in the art without departing from the scope and spirit of the invention.

What is claimed is:

1. A heat shrink gas gun comprising:

a handle, wherein the handle has a back side and a front side, and wherein the front side includes a cavity extending along an axis;

an igniter, which is configured for ignition of the heat shrink gas gun and is actuated by a trigger, insertably disposed in the cavity, wherein the igniter is releasably received in the cavity; and a trigger guard positioned in front of the trigger and the front side in a spaced relationship and including a through hole corresponding to the cavity so as to facilitate installation and replacement of the igniter.

2. The heat shrink gas gun as claimed in claim 1, wherein the trigger is movably connected to the handle and selectively closes the cavity, wherein the trigger is movable to a disengaging position, a first engaging position, and a second engaging position, wherein the cavity is open for insertion of the igniter when the trigger is at the disengaging position, wherein the cavity is closed by the trigger when the trigger is at either the first or the second engaging positions, and wherein the igniter is in an idle position when the trigger is at the first engaging position and is in an employed position when the trigger is at the second engaging position.

3. The heat shrink gas gun as claimed in claim 2, wherein the trigger is pivotally connected to the handle.

4. The heat shrink gas gun as claimed in claim 1 further comprising a valve device disposed in the handle, which has an inlet end connectible to a fuel supply and selectively allows fuel to feed the heat shrink gas gun, actuated by the trigger.

5. The heat shrink gas gun as claimed in claim 4, wherein the valve device defines an inlet passage and an outlet passage, which cooperatively allow fuel to flow from the inlet end to feed the heat shrink gas gun, interconnected by a passage, and wherein the valve device includes a valve shaft, which is configured to selectively permit and prevent communication of the inlet and the outlet passages, movably disposed in the passage and actuated by the trigger.

6. The heat shrink gas gun as claimed in claim 5, wherein the valve shaft moves axially between a first position in which the inlet and the outlet passages are communicated and a second position in which the inlet and the outlet passages are not communicated.

7. The heat shrink gas gun as claimed in claim 5, wherein the valve shaft is urged by a resilient member.

8. The heat shrink gas gun as claimed in claim 5, wherein the passage extends transversely to the inlet and the outlet passages.

9. The heat shrink gas gun as claimed in claim 8, wherein the passage is stepped.

10. The heat shrink gas gun as claimed in claim 5, wherein the valve device is actuated by the trigger via a linkage, wherein the valve shaft is connected with the linkage, and wherein the linkage is pivotally mounted in the handle.

11. The heat shrink gas gun as claimed in claim 2 further comprising a valve device disposed in the handle, which has an inlet end connectible to a fuel supply and selectively allows fuel to feed the heat shrink gas gun, actuated by the trigger.

12. The heat shrink gas gun as claimed in claim 11, wherein the valve device defines an inlet passage and an outlet passage, which cooperatively allow fuel to flow from the inlet end to feed the heat shrink gas gun, interconnected by a passage, and wherein the valve device includes a valve shaft, which is configured to selectively permit and prevent communication of the inlet and the outlet passages, movably disposed in the passage and actuated by the trigger.

13. The heat shrink gas gun as claimed in claim 12, wherein the valve device is actuated by the trigger via a linkage, wherein the valve shaft is connected with the linkage, and wherein the linkage is pivotally mounted in the handle and pivots to move the valve shaft to a position in which the inlet and the outlet passages are communicated in response to moving the trigger from the first engaging position to the second engaging position.

14. The heat shrink gas gun as claimed in claim 13, wherein the valve shaft is urged by a resilient member which recovers to its original shape after the trigger moves from the second engaging position to the first engaging position.

15. The heat shrink gas gun as claimed in claim 14, wherein the passage extends transversely to the inlet and the outlet passages.

16. The heat shrink gas gun as claimed in claim 1, wherein the trigger guard is U shaped and includes one end disposed at an upper end of the handle and another end disposed at a lower end of the handle respectively, and wherein the handle and the trigger guard cooperatively define a space.

17. The heat shrink gas gun as claimed in claim 11, wherein the trigger guard is U shaped and includes one end disposed at an upper end of the handle and another end disposed at a lower end of the handle respectively, and wherein the handle and the trigger guard cooperatively define a space.

18. The heat shrink gas gun as claimed in claim 14, wherein the trigger guard is U shaped and includes one end disposed at an upper end of the handle and another end disposed at a lower end of the handle respectively, and wherein the handle and the trigger guard cooperatively define a space.

19. The heat shrink gas gun as claimed in claim 10, wherein the trigger is pivotally connected to the handle.

20. The heat shrink gas gun as claimed in claim 14, wherein the trigger is pivotally connected to the handle.

21. The heat shrink gas gun as claimed in claim 17, wherein the trigger is pivotally connected to the handle.

* * * * *